US010450528B2

(12) United States Patent
Honda et al.

(10) Patent No.: US 10,450,528 B2
(45) Date of Patent: Oct. 22, 2019

(54) LUBRICANT COMPOSITION

(71) Applicants: ExxonMobil Research and Engineering Company, Annandale, NJ (US); Toyota Jidosha Kabushiki Kaisha, Toyota-shi Aichi-ken (JP)

(72) Inventors: Takashi Honda, Kawasaki (JP); Ko Onodera, Kawasaki (JP); Kosuke Fujimoto, Toyota (JP)

(73) Assignees: ExxonMobil Research and Engineering Company, Annandale, NJ (US); Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 39 days.

(21) Appl. No.: 15/565,072

(22) PCT Filed: Apr. 6, 2016

(86) PCT No.: PCT/JP2016/061305

§ 371 (c)(1),
(2) Date: Oct. 6, 2017

(87) PCT Pub. No.: WO2016/163424

PCT Pub. Date: Oct. 13, 2016

(65) Prior Publication Data

US 2018/0100112 A1 Apr. 12, 2018

(30) Foreign Application Priority Data

Apr. 6, 2015 (JP) ..... 2015-077616

(51) Int. Cl.
*C10M 159/04* (2006.01)
*C10M 107/02* (2006.01)
(Continued)

(52) U.S. Cl.
CPC ..... *C10M 107/02* (2013.01); *C10M 105/04* (2013.01); *C10M 105/38* (2013.01);
(Continued)

(58) Field of Classification Search
CPC ..... C10N 2220/031; C10M 159/04
(Continued)

(56) References Cited

U.S. PATENT DOCUMENTS

2004/0094453 A1 5/2004 Lok et al.
2004/0242436 A1* 12/2004 Ryan, III ..... C10M 169/04 508/382

(Continued)

FOREIGN PATENT DOCUMENTS

JP H10147790 A 6/1998
JP 2003201496 A 7/2003

(Continued)

OTHER PUBLICATIONS

SAE International, 2013-01-2500, "Influence of Engine Oil Properties on Soot Containing Deposit Formation in Turbocharger Compressor", Norihiko Sumi et al., published Oct. 14, 2013.

*Primary Examiner* — Ellen M Mcavoy
(74) *Attorney, Agent, or Firm* — Dinsmore & Shohl LLP

(57) ABSTRACT

A lubricant composition improves a performance of reducing a formation of compressor deposit. The lubricant composition also ensures low temperature properties of the lubricant composition. The lubricant composition includes 14 mass % or more of a fraction having a boiling point of 500° C. to 550° C. and 5 mass % or more of a fraction having a boiling point of over 550° C.

20 Claims, 3 Drawing Sheets

(1) GCD curve of the ester oil of Reference Example 1

(2) GCD curve of the ester oil of Reference Example 2

(3) GCD curve of the ester oil of Comparative Example 1

(51) Int. Cl.

| | |
|---|---|
| ***C10M 105/04*** | (2006.01) |
| ***C10M 105/40*** | (2006.01) |
| ***C10M 171/00*** | (2006.01) |
| ***C10M 105/38*** | (2006.01) |
| ***C10M 107/10*** | (2006.01) |

(52) U.S. Cl.
CPC ..... *C10M 105/40* (2013.01); *C10M 107/10* (2013.01); *C10M 171/005* (2013.01); *C10M 2203/102* (2013.01); *C10M 2205/0206* (2013.01); *C10M 2205/0285* (2013.01); *C10M 2205/173* (2013.01); *C10M 2207/2815* (2013.01); *C10M 2207/2825* (2013.01); *C10M 2207/2835* (2013.01); *C10M 2209/084* (2013.01); *C10N 2220/022* (2013.01); *C10N 2220/031* (2013.01); *C10N 2230/02* (2013.01); *C10N 2230/04* (2013.01); *C10N 2230/74* (2013.01); *C10N 2240/10* (2013.01); *C10N 2240/102* (2013.01); *C10N 2240/103* (2013.01)

(58) Field of Classification Search
USPC ..... 208/19
See application file for complete search history.

(56) References Cited

U.S. PATENT DOCUMENTS

2005/0098476 A1* 5/2005 Miller ..... C10M 111/00 208/19
2006/0196807 A1* 9/2006 Rosenbaum ..... C10M 111/04 208/19
2006/0293193 A1* 12/2006 Rosenbaum ..... C10M 105/04 508/110
2008/0053868 A1* 3/2008 Kleijwegt ..... C10M 143/00 208/18
2008/0110799 A1 5/2008 Matsui et al.
2009/0143261 A1* 6/2009 Takeoka ..... C10M 107/02 508/110
2009/0149357 A1* 6/2009 McGeehan ..... C10M 107/02 508/110
2009/0312205 A1* 12/2009 Colbourne ..... C10M 105/04 508/110
2010/0270206 A1* 10/2010 Timar ..... C10M 169/04 208/18
2011/0087057 A1* 4/2011 Sirota ..... C10M 107/02 585/9
2011/0290702 A1* 12/2011 Germaine ..... C10M 111/04 208/19
2013/0090272 A1* 4/2013 Rosenbaum ..... C10M 1/08 508/110
2013/0333654 A1* 12/2013 Wedlock ..... C10M 111/02 123/1 A
2015/0045271 A1 2/2015 Yoshida
2015/0060329 A1* 3/2015 Wedlock ..... C10M 111/04 208/19
2015/0337220 A1* 11/2015 Litz ..... C10G 27/12 208/15
2016/0145512 A1* 5/2016 Lyon ..... C10G 69/02 208/19

FOREIGN PATENT DOCUMENTS

JP 2006506506 A 2/2006
JP 2008120909 A 5/2008
JP 2012500315 A 1/2012
JP 2012518049 A 8/2012
JP 2013199594 A 10/2013
JP 2015025079 A 2/2015
WO 2010020653 A2 2/2010
WO 2010094681 A1 8/2010

* cited by examiner (1) GCD curve of the ester oil of Reference Example 1

(2) GCD curve of the ester oil of Reference Example 2

(3) GCD curve of the ester oil of Comparative Example 1

(1) GCD curve of the lubricant composition of Reference Example 1

(2) GCD curve of the lubricant composition of Reference Example 2

LUBRICANT COMPOSITION

CROSS-REFERENCE TO RELATED APPLICATIONS

This application is a U.S. national stage application of PCT/JP2016/061305 filed Apr. 6, 2016, which claims priority to Japanese Patent Application 2015-077616 filed Apr. 6, 2015, which is incorporated herein by reference in its entirety.

TECHNICAL FIELD

The present disclosure relates to a lubricant composition, particularly a lubricant composition for internal-combustion engines. More specifically, the present disclosure relates to a lubricant composition for diesel engines.

BACKGROUND ART

In recent years, there have been a variety of requirements, such as improved fuel efficiency and compliance with emission regulations for internal-combustion engines. In response to these requirements, in diesel-engine vehicles, a method of improving fuel efficiency by increasing the supercharging pressure of a turbocharger, improving engine output ratio and thereby achieving a reduction in engine size have been widely adopted. Further, in order to comply with emission regulations, a low-pressure loop (LPL)-EGR system for increasing the amount of exhaust gas recirculation (EGR) gas has been increasingly adopted.

In a compressor of a turbocharger equipped with an LPL-EGR system, the compressor outlet temperature is increased when the supercharging pressure of the turbocharger is increased, and soot-containing deposit originated from an engine oil are formed in the compressor (hereinafter, such deposits are referred to as "compressor deposits"). Since this deposit formation reduces the turbocharger efficiency, the output temperature must be controlled in order to prevent the formation of such deposits. Accordingly, increasing the output temperature by inhibiting the deposit formation has been studied. Non-patent Literature 1 describes that the evaporation characteristics of an engine oil affects the deposit formation and the deposit formation can be suppressed by limiting the amount of light fraction in the oil. Patent Literature 1 describes that sludge formation in the turbo mechanism of an engine equipped with a direct-injection turbo mechanism is inhibited by reducing the amount of light fraction of a lubricant composition.

Patent Literature 2 discloses a lubricant composition which is used for reducing the total hydrocarbon emissions from a diesel engine and comprises a Fischer-Tropsch-derived base oil and at least one additive. Patent Literature 3 discloses a lubricant composition which provides improved fuel efficiency characteristics while maintaining desirable wear performance and NOACK volatility, and discloses that when a Fischer-Tropsch-derived base oil is not used, volatility control is not lost. However, neither Patent Literature 2 nor Patent Literature 3 describes deposit reduction focusing on the distillation characteristics of the Fischer-Tropsch-derived base oil.

Patent Literature 4 discloses a lubricant composition for attaining lubricity and heat resistance at high temperatures in a turbocharger lubricant, which lubricant composition comprises a combination of base oils each having a specific kinematic viscosity and additives. However, Patent Literature 4 does not describe that deposits are attributed to the distillation characteristics of the base oils.

CITATIONS LIST

Patent Literature

Patent Literature 1: Japanese Unexamined Patent Publication (Kokai) No. 2015-25079

Patent Literature 2: Published Japanese Translation of PCT International Publication for Patent Application (Kohyo) No. 2012-518049

Patent Literature 3: Published Japanese Translation of PCT International Publication for Patent Application (Kohyo) No. 2012-500315

Patent Literature 4: Japanese Unexamined Patent Publication (Kokai) No. 2013-199594

Non-Patent Literature

Non-patent Literature 1: SAE INTERNATIONAL, 2013-01-2500, "Influence of Engine Oil Properties on Soot Containing Deposit Formation in Turbocharger Compressor", Norihiko Sumi, et al., Oct. 14, 2013

SUMMARY

Technical Problem

As described in Non-patent Literature 1 and Patent Literature 1, in order to inhibit the formation of compressor deposits, it is desired to limit the amount of light fraction; however, the formation of compressor deposits may not be sufficiently inhibited even when a lubricant composition containing a large amount of a high-boiling-point fraction with a limited amount of light fraction is used. Further, engine oil that improves fuel efficiency by ensuring good low-temperature characteristics has been sought. In order to attain required low-temperature characteristics, it is necessary to appropriately design a base oil of the engine oil; however, the technology of securing a high-boiling-point fraction and the technology of ensuring good low-temperature characteristics sometimes conflict with each other. Incorporation of a large amount of a high-boiling-point component as described above may adversely affect the low-temperature characteristics of the engine oil.

In view of the above circumstances, a first object of the present disclosure is to provide a lubricant composition whose performance of inhibiting the formation at compressor deposits is further improved. A second object of the present disclosure is to ensure the low-temperature characteristics of the lubricant composition in addition to the above effect. In the present disclosure, the term "compressor deposits" refers to deposits containing engine oil-derived soot formed in a turbocharger compressor.

Solution to Problem

The present disclosure provides a lubricant composition which is characterized by comprising not less than 14% by weight of a fraction having a boiling point of 500° C. to 550° C., and not less than 5% by weight of a fraction having a boiling point of higher than 550° C.

The present disclosure also provides a lubricant composition further having at least one of the following characteristic features (a) to (h):

(a) a lubricant composition having a NOACK evaporation amount of not more than 20% by weight;

(b) a lubricant composition having a CCS viscosity at −35° C. of not more than 6.2 Pa·s;

(c) a lubricant composition comprising not less than 45% by weight of paraffin;

(d) a lubricant composition comprising not less than 45% by weight of paraffin and not less than 1% by weight of monocyclic naphthene;

(e) a lubricant composition having a high-temperature high-shear viscosity (HTHS viscosity) of 2.0 to 3.5 mPa·s at 150° C.;

(f) a lubricant composition comprising an ester base oil;

(g) a lubricant composition comprising a PAO (poly-α-olefin) base oil; and (h) a lubricant composition comprising a Fischer-Tropsch-derived base oil (hereinafter, may be abbreviated as "FT base oil").

The lubricant composition of the present disclosure is particularly a lubricant composition for internal-combustion engines, more particularly a lubricant composition for diesel engines. Further, the present disclosure provides a method of inhibiting the formation of compressor deposits by using the above lubricant composition in a diesel engine.

Advantageous Effects

In the lubricant composition of the present disclosure, the performance of inhibiting the formation of compressor deposits can be further improved by incorporating the above two fractions having a specific boiling point, range, each in not less than a specific amount. Furthermore, the present, disclosure can provide a lubricant composition which exhibits the above effect and has good low-temperature characteristics. The term "good low-temperature characteristics" used herein refers to, in particular, an ability of maintaining a low viscosity even at low temperatures and having good low-temperature startability and fuel economy performance.

DESCRIPTION OF EMBODIMENTS

Figure 1:
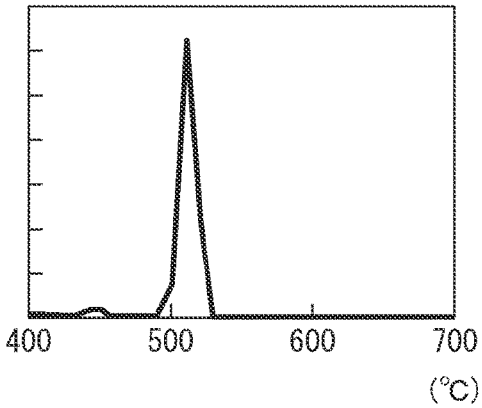
FIG. 1 provides GCD curves of the respective ester oils used in Reference Examples 1 and 2 and Comparative Example 1.
Figure 1:
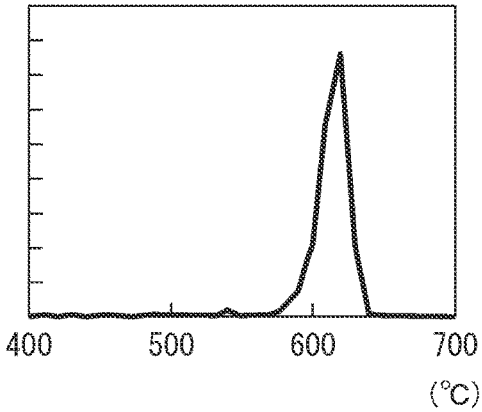
Figure 1:
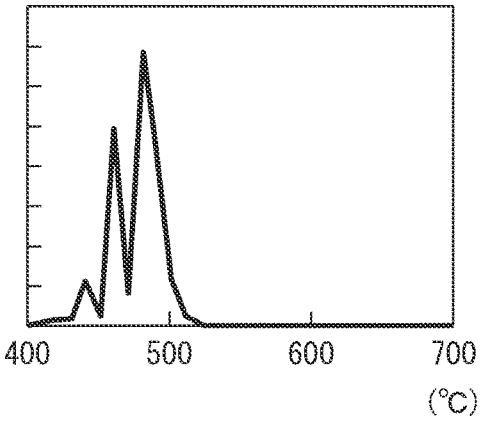

The lubricant composition of the present disclosure comprises (1) not less than 14% by weight of a fraction having a boiling point of 500° C. to 550° C., and (2) not less than 5% by weight of a fraction having a boiling point of higher than 550° C. The lubricant composition of the present disclosure is characterized by comprising these two high-boiling-point fractions having the respective boiling point ranges indicated in (1) and (2) above, each in not less than a specific amount. The fraction having a boiling point of 500° C. to 550° C. and the fraction having a boiling point of higher than 550° C. both have an effect of inhibiting the formation of compressor deposits. However, even if only the fraction having a boiling point of 500° C. to 550° C. is incorporated in a large amount, the formation of compressor deposits cannot be sufficiently inhibited. By incorporating a combination of the fraction having a boiling point of 500° C. to 550° C. and the fraction having a boiling point of higher than 550° C. in not less than the respective prescribed amounts, the formation of compressor deposits can be more effectively inhibited.

(1) In some embodiments of the lubricant composition of the present disclosure, the content of the fraction having a boiling point of 500° C. to 550° C. is not less than 14% by weight, not less than 16% by weight, not less than 18% by weight, not less than 20% by weight, not less than 22% by weight, based on the weight of the whole composition. The formation of compressor deposits can be inhibited when the content of the fraction having a boiling point of 500° C. to 550° C. is not less than the above lower limit value. When the content is less than the lower limit value, the effect of inhibiting the formation of compressor deposits cannot be sufficiently obtained, and the turbo efficiency may thus be reduced. In some embodiments, the upper limit value of the content of the fraction having a boiling point of 500° C. to 550° C. is not more than 50% by weight, is not more than 45% by weight, not more than 40% by weight, not more than 35% by weight. A content of higher than this upper limit is not selected since it may cause a large increase in the viscosity at low temperatures. The amount of the fraction having a boiling point of 500° C. to 550° C. can be measured by distillation gas chromatography. The measurement conditions and the like are described below.

(2) In some embodiments of the lubricant composition of the present disclosure, the content of the fraction having a boiling point of higher than 550° C. is not less than 5% by weight, not less than 6% by weight, not less than 7% by weight, based on the weight of the whole composition. This fraction is particularly a fraction having a boiling point of higher than 550° C. and not higher than 650° C., more particularly higher than 550° C. and not higher than 600° C. However, since the fraction having a boiling point of higher than 550° C. is too heavy, an excessively high content of this fraction causes an increase in the viscosity at low temperatures, which leads to poor fuel efficiency. Therefore, in order to ensure good viscosity at low temperatures and good fuel efficiency, in some embodiments, the upper limit value of the content of the fraction having a boiling point of higher than 550° C. is not more than 20% by weight, not more than 16% by weight, not more than 12% by weight, based on the whole composition.

The content of the fraction having a boiling point of lower than 500° C. is not particularly limited as long as the content of the fraction having a boiling point of 500° C. to 550° C. and that of the fraction having a boiling point of higher than 550° C. satisfy the above respective ranges. In some embodiments, the total content of fractions having a boiling point of not higher than 499° C., not higher than 496° C., not more than 80% by weight, not more than 69% by weight, based on the weight of the whole composition. By this, a reduction in the turbo efficiency can be more effectively inhibited.

(a) It is appropriate that in some embodiments, the lubricant composition of the present disclosure has a NOACK evaporation amount of not more than 20% by weight, not more than 18% by weight, not more than 15% by weight, not more than 13% by weight. When the NOACK evaporation amount is greater than this upper limit, the effect of inhibiting the formation of compressor deposits cannot be sufficiently obtained, and the turbo efficiency may thus be reduced. In some embodiments, the NOACK evaporation amount is, but not limited to, not less than 1% by weight, not less than 2% by weight, not less than 3% by weight. The NOACK evaporation amount is a value measured in accordance with ASTM D5800 at 250° C. for 1 hour.

(b) It is appropriate that in some embodiments, the lubricant composition of the present disclosure has a CCS viscosity (cold-cranking simulator viscosity) at −35° C. of not more than 6.2 Pa·s, not more than 6.1 Pa·s, still not more than 6.0 Pa·s. By controlling the CCS viscosity at −35° C. to be not more than this upper limit value, good low-temperature characteristics can be ensured. When the CCS viscosity at −35° C. is more than the upper limit value, the low-temperature startability is impaired due to a reduction in the low-temperature fluidity, and this may cause further deterioration of the fuel economy performance. In some embodiments, the CCS viscosity is, but not limited to, not less than 3.0 Pa·s, not less than 4.0 Pa·s, not less than 5.0 Pa·s. The CCS viscosity at −35° C. is a value measured) in accordance with ASTM D5293. In some embodiments, in order to ensure such low-temperature viscosity characteristics, the content of the fraction having a boiling point of 500° C. to 550° C. is controlled to be not more than 50% by weight, not more than 45% by weight, not more than 40% by weight, not more than 35% by weight, based on the whole composition; and the content of the fraction having a boiling point of higher than 550° C. is controlled to be not more than 20% by weight, not more than 16% by weight, not more than 12% by weight, based on the whole composition.

(c) The lubricant composition of the present disclosure comprises paraffin in an amount of not less than 45% by weight, not less than 50% by weight, not less than 55% by weight. By incorporating paraffin in this prescribed amount, an increase in the viscosity of the lubricant composition at low temperatures can be inhibited. In some embodiments, the paraffin content may be, but not limited to, not more than 90% by weight, not more than 80% by weight.

(d) Further, in addition to paraffin, the lubricant composition of some embodiments of the present disclosure may also contain monocyclic naphthene in an amount of not less than 1% by weight, not less than 3% by weight, not less than 5% by weight, not less than 7% by weight. When the lubricant composition contains an excessively large amount of monocyclic naphthene, the viscosity characteristics at low temperatures may be deteriorated. Therefore, in some embodiments, the monocyclic naphthene content is not more than 40% by weight, not more than 30% by weight, not more than 20% by weight. The paraffin content and the monocyclic naphthene content were measured by "field desorption ionization-mass spectrometry (FD-MS method)". An FD method is a method of ionizing a sample by uniformly coating the sample on an emitter and applying an electric current to the emitter at a constant rate. The types of molecular ions are analyzed, and the content of each molecule is calculated from the ratio of the ionic strength of each molecule. The measurement may be performed in accordance with, for example, the method described in "Type Analysis of Lubricant Base Oil by Mass Spectrometer," Nisseki Technical Review, vol. 33, no. 4, October 1991, pages 135-142.

(e) It is appropriate that in some embodiments of the lubricant composition of the present disclosure has a high-temperature high-shear viscosity (HTHS viscosity) at 150° C. of 2.0 to 3.5 mPa·s, 2.3 to 3.2 mPa·s, 2.6 to 2.9 mPa·s. The HTHS viscosity can be measured in accordance with, for example, ASTM D4683 using a TBS viscometer. By controlling the HTHS viscosity within the above range, proper fuel efficiency characteristics can be maintained while ensuring engine durability.

A lubricant base oil constituting the lubricant composition of the present disclosure can be selected as appropriate from conventionally known lubricant base oils and may be prepared by combining and mixing base oils such that the above requirements of the present disclosure are satisfied. For example, the lubricant base oil can be prepared by combining and mixing a base oil containing a large amount of a heavy fraction and a base oil containing a large amount of light fraction. In some embodiments, the base oil containing a large amount of a heavy fraction is one which contains a fraction having a boiling point of not lower than 500° C. in an amount of not less than 17% by weight, not less than 20% by weight, not less than 30% by weight, and has a relatively high low-temperature viscosity. Further, in some embodiments, a base oil having a NOACK evaporation amount, which is measured at 250° C. for 1 hour, of not more than 10% by weight, not more than 8% by weight, is appropriate. In some embodiments, the NOACK evaporation amount of the base oil containing a large amount of a heavy fraction is, but not limited to, not less than 1% by weight, not less than 1.5% by weight. In some embodiments, the base oil containing a large amount of light fraction is one which has a relatively low low-temperature viscosity, a base oil having a CCS viscosity at −35° C. of not more than 3.0 Pa·s, not more than 2.5 Pa·s. Further, in some embodiments, a base oil having a NOACK evaporation amount, which is measured at 250° C. for 1 hour, of not more than 50% by weight or less, not more than 45% by weight or less, is appropriate. In some embodiments, the NOACK evaporation amount of the base oil containing a large amount of light fraction is, but not limited to, more than 10% by weight, not less than 12% by weight. In some embodiments, the blending ratio of the base oil containing a large amount of light fraction to the base oil containing a large amount of a heavy fraction may be selected as appropriate such that, in the lubricant composition, the content of the fraction having a boiling point of 500 to 550° C. is not less than 14% by weight, not less than 16% by weight, not less than 18% by weight, not less than 20% by weight, not less than 22% by weight, and the content of the fraction having a boiling point of higher than 550° C. is not less than 5% by weight, not less than 6% by weight, not less than 7% by weight.

In the present disclosure, the lubricant base oil may be any one of mineral base oils and synthetic base oils, and these base oils may be used individually or in combination. Examples of the mineral base oils include a base oil produced by vacuum-distilling an atmospheric distillation residue of a paraffin-based, intermediate-based or naphthene-based crude oil to obtain a lubricant fraction as a vacuum distillate and refining the lubricant fraction of through an arbitrarily selected treatment such as solvent deasphalting, solvent extraction, hydrocracking, hydrotreatment, solvent dewaxing, hydrorefining or clay treatment; mineral oils obtained by isomerization of wax content; FT base oils; vegetable oil-derived base oils; and mixed base oils thereof. For solvent refining, for example, an aromatic extraction solvent such as phenol, furfural or N-methyl-2-pyrrolidone is used. For solvent dewaxing, for example, a solvent such as liquefied propane or MEK/toluene is used. For catalytic dewaxing, for example, shape-selective zeolite is used as a dewaxing catalyst.

Examples of the synthetic base oils include poly-α-olefins such as 1-octene oligomer, 1-decene oligomer and 1-dodecene oligomer, and hydrogenated products thereof; esters of a dicarboxylic acid and an alcohol, wherein examples of the dicarboxylic acid include phthalic acid, succinic acid, alkyl succinic acid, alkenyl succinic acid, maleic acid, azelaic acid, suberic acid, sebacic acid, fumaric acid, adipic acid and linoleic acid dimer, and examples of the alcohol include butyl alcohol, hexyl alcohol, 2-ethylhexyl alcohol, isodecyl alcohol, dodecyl alcohol, ethylene glycol, diethylene glycol monoether and propylene glycol; esters of a monocarboxylic acid having 4 to 20 carbon atoms and a polyol, wherein examples of the polyol include neopentyl glycol, trimethylolpropane, pentaerythritol, dipentaerythritol, and tripentaerythritol; polybutenes and hydrogenated products thereof; anaromatic synthetic oils, such as polyphenyls (e.g., biphenyl and alkylated polyphenyls), alkylnaphthalenes, alkylbenzenes and aromatic esters; and mixtures of these synthetic oils.

In some embodiments, the above lubricant composition of the present disclosure is specified into the following three modes:

(I) a lubricant composition comprising an ester base oil, characterized in that the content of a fraction having a boiling point of 500° C. to 550° C. is not less than 14% by weight based on the total weight of the composition and the content of a fraction having a boiling point of higher than 550° C. is not less than 5% by weight based on the total weight of the composition;

(II) a lubricant composition comprising a Fischer-Tropsch-derived base oil (FT base oil), characterized in that the content of a fraction having a boiling point of 500° C. to 550° C. is not less than 14% by weight based on the total weight of the composition and the content of a fraction having a boiling point of higher than 550° C. is not less than 5% by weight based on the total weight of the composition; and (III) a lubricant composition comprising a PAO (poly-α-olefin) base oil, characterized in that the content of a fraction having a boiling point of 500° C. to 550° C. is not less than 14% by weight based on the total weight of the composition and the content of a fraction having a boiling point of higher than 550° C. is not less than 5% by weight based on the total weight of the composition.

In some embodiments, these lubricant compositions has at least one of the properties described in the above (a) to (e).

(I) The above first mode is a lubricant composition comprising an ester base oil. By incorporating an ester base oil, excellent additive solubility can be characteristically ensured. The ester base oil may be selected as appropriate from the above ones. In some embodiments, the ester base oil has a boiling point of 500° C. or higher; however, the ester base oil may be one which contains a large amount of light fraction. As appropriate, the ester base oil is incorporated in combination with the above other lubricant base oil(s). The ester base oil can also be used in combination with the below-described PAO base oil. By incorporating such a high-boiling-point ester base oil, the NOACK evaporation amount of the lubricant composition can be reduced and an increase in the viscosity after a deposit simulation test can be inhibited. Examples of the ester base oil having a boiling point of not lower than 500° C. include an ester of trimethylolpropane and capric acid, and an ester of trimethylolpropane and stearic acid. In some embodiments, the ester of trimethylolpropane and capric acid, which has a boiling point of 500° C. to 550° C. and a low viscosity, is used. Further, as the ester base oil which contains a large amount of light fraction, trimethylolpropane-capric acid-caprylic acid ester can be suitably used. The content of the ester base oil may be adjusted as appropriate in accordance with the properties of the lubricant base oil to be used in combination. In some embodiments, the content of the ester base oil in the lubricant composition is not less than 1% by weight, not less than 3% by weight, not less than 5% by weight, not less than 10% by weight. In some other embodiments, the content of the ester base oil is not more than 50% by weight, 45% by weight, not more than 30% by weight.

(II) The above second mode is a lubricant composition comprising a Fischer-sober-derived base oil (FT base oil). By incorporating an FT base oil, low fuel consumption attributed to excellent viscosity properties can be characteristically ensured. In some embodiments, the FT base oil is a GTL (gas-to-liquid) base oil, an ATL (asphait-to-liquid) base oil, a BTL (biomass-to-liquid) base oil or a CTL (coal-to-liquid) base oil, a GTL base oil. A Fischer-Tropsch wax can also be used as a base oil, and the process of using a Fischer-Tropsch wax as a material is described in U.S. Pat. Nos. 4,594,172 and 4,943,672. A lubricant composition satisfying the above requirements of the present disclosure can be obtained by appropriately combining and mixing, for example, an FT base oil containing a large amount of a heavy fraction and an FT base oil containing a large amount of light fraction. In some embodiments, the FT base oil containing a large amount of a heavy fraction is one which contains a fraction having a boiling point of not lower than 500° C. in an amount of not less than 45% by weight, not less than 50% by weight, and has a relatively high low-temperature viscosity. Further, in some embodiments, a base oil having a NOACK evaporation amount, which is measured at 250° C. for 1 hour, of not more than 10% by weight, not more than 8% by weight, not more than 5% by weight, is more appropriate. In some embodiments, the NOACK evaporation amount of the FT base oil containing a large amount of a heavy fraction is, but not limited to, not less than 1% by weight, not less than 1.5% by weight. Further, in some embodiments, the FT base oil containing a large amount of a heavy fraction has a kinematic viscosity at 100° C. of 5 to 10 $mm^2/s$, 6 to 9 $mm^2/s$, 7 to 8 $mm^2/s$. The FT base oil containing a large amount of light fraction is one which has a relatively low low-temperature viscosity. In some embodiments, the CCS viscosity thereof at −35° C. is not more than 3.0 Pa·s, not more than 2.0 Pa·s, not more than 1.5 Pa·s, not more than 1.0 Pa·s. Further, in some embodiments, a base oil having a NOACK evaporation amount, which is measured at 250° C. for 1 hour, of not more than 50% by weight, not more than 45% by weight, is appropriate. In some embodiments, the NOACK evaporation amount of the FT base oil containing a large amount of light fraction is, but not limited to, more than 10% by weight, not less than 12% by weight. In some embodiments, three or more of these FT base oils may be used in combination. In some embodiments, the FT base oils may also be incorporated in combination with the above other lubricant base oils, such as a PAO base oil and a refined base oil. The blending ratio of the FT base oil containing a large amount of a heavy fraction to the FT base oil containing a large amount of light fraction may be adjusted as appropriate such that the above requirements of the present disclosure are satisfied. The content of the FT base oils is not particularly limited and may be adjusted as appropriate in accordance with the properties of the lubricant base oil to be used in combination. In some embodiments, the FT base oils can be incorporated into the lubricant composition in a total amount of not less than 20% by weight, not less than 40% by weight, not less than 60% by weight. In some embodiments, the content of the FT base oils is, but not limited to, not more than 95% by weight, not more than 90% by weight.

(III) The above third mode is a lubricant composition comprising a PAO (poly-α-olefin) base oil. By incorporating a PAO base oil, excellent oxidation stability and low-temperature fluidity can be characteristically ensured. As the poly-α-olefin, for example, 1-octene oligomer, 1-decene oligomer or 1-dodecene oligomer can be suitably used. As appropriate, the PAO base oil may be incorporated in combination with the above other lubricant base oils, such as the above FT base oils and refined base oils. In some embodiments, the total content of the PAO base oil in the lubricant composition is not less than 1% by weight, not less than 5% by weight, not, less than 10% by weight, not less than 20% by weight. In some embodiments, the total content of the PAO base oil is, but not limited to, not more than 95% by weight, not more than 80% by weight, not more than 60% by weight.

In some embodiments, the kinematic viscosity ($mm^2/s$) of each lubricant base oil at 100° C. is, but not limited to, 2 to 15 $mm^2/s$, 2 to 10 $mm^2/s$, 2 to 8 $mm^2/s$. By this, a composition which sufficiently forms an oil film and has excellent lubricity and whose evaporation loss is further reduced can be obtained.

In some embodiments, the viscosity index (VI) of each lubricant base oil is, but not limited to, not less than 100, not less than 110, not less than 120. By this, an oil film can be surely formed at a high temperature and the viscosity at low temperatures can be reduced. The kinematic viscosity and the viscosity index are measured in accordance with ASTM D445.

Each lubricant base oil may have any kinematic viscosity ($mm^2/s$) at 40° C. as long as the value thereof can be determined from the above kinematic viscosity at 100° C. and the above viscosity index (VI).

As each lubricant base oil, a base oil which belongs to any of Groups I, II, III, IV and V, which are base oil categories defined by American Petroleum Institute (API), can be utilized as appropriate. For example, a PAO that can be used in the present disclosure may be a PAO classified into Group IV.

API base oil classification

| | Base oil properties | | | | |
|---|---|---|---|---|---|
| | Degree of saturation (% by weight) | | Sulfur (% by weight) | | Viscosity index |
| Group I | <90 | and/or | >0.03 | and | 80 to 119 |
| Group II | ≥90 | and | ≤0.03 | | 80 to 119 |
| Group III | ≥90 | and | ≤0.03 | | ≥120 |
| Group IV | poly-α-olefin (PAO) | | | | |
| Group V | all other base oils not included in Groups I to IV (e.g., esters) | | | | |

In the lubricant composition of the present disclosure, a variety of additives can be incorporated. The additives include metal detergents, antiwear agents, friction modifiers, antioxidants, ashless dispersants, viscosity index improvers, extreme pressure agents, corrosion inhibitors, rust inhibitors, pour point depressants, demuisifiers, metal deactivators, and antifoaming agents, and the additives may be selected as appropriate and incorporated within a range that does not interfere with the object of the present disclosure.

Examples of the metal detergents include alkaline earth metal sulfonates, alkaline earth metal phenates, alkaline earth metal salicylates, and mixtures thereof. The alkaline earth metal includes calcium, magnesium, barium, and the like. The metal detergents are, for example, calcium sulfonate, calcium phenate, calcium salicylate, magnesium sulfonate, magnesium phenate, magnesium salicylate, and the like. In some embodiments, the metal detergents are calcium salts. These alkaline earth metal salts may be neutral salts or basic salts. Further, a boron-containing calcium-based detergent can be used. In the present disclosure, a sodium-containing metal detergent can also be used as an optional component within a range that does not change the gist of the disclosure. In some embodiments, the sodium-containing metal detergent is sodium sulfonate, sodium phenate, or sodium salicylate. These metal detergents may be used individually, or in combination of two or more thereof. The sodium-containing metal detergent can be used in combination with the above calcium-containing metal detergent(s) and/or magnesium-containing metal detergent(s). By incorporating these metal detergents, high-temperature detergency and rust resistance that are required for a lubricant can be ensured. The amount of the metal detergents in the lubricant composition may be selected as appropriate in accordance with a conventionally known method, and in some embodiments the amount of the metal detergents in the lubricant composition is not more than 10% by weight, and in some other embodiments the amount of the metal detergents in the lubricant composition is not more than 5% by weight.

Examples of the antiwear agents include phosphorus compounds, such as zinc dithiophosphate, zinc alkylphosphates, metal dithiophosphate, metal dithiocarbamates, phosphates and phosphites; phosphoric acid ester, phosphorous acid ester, and metal salts and amine salts thereof; metal naphthanates; fatty acid metal salts; and the like. In some embodiments, the antiwear agents are phosphorus-containing antiwear agents, and in some other embodiments, the antiwear agents are zinc dithiophosphate. These antiwear agents may be used individually, or in combination of two or more thereof. Examples of metals in the above metal salts include alkali metals, such as lithium, sodium, potassium and cesium; alkaline earth metals, such as calcium, magnesium and barium; and heavy metals, such as zinc, copper, iron, lead, nickel, silver and manganese. In some embodiments, the metals are alkaline earth metals, such as calcium and magnesium, and zinc. In some embodiments, the amount of the antiwear agent(s) may be selected as appropriate in accordance with a conventionally known method, and it is not more than 5% by weight, not more than 3% by weight.

Examples of the friction modifiers include sulfur-containing organic molybdenum compounds, such as molybdenum dithiophosphate (MoDTP) and molybdenum dithiocarbamate (MoDTC); complexes of a molybdenum compound and a sulfur-containing organic compound or other organic compound; complexes of a sulfur-containing molybdenum compound, such as molybdenum sulfide or sulfurized molybdic acid, and an alkenyl succinimide; molybdenum-amine complexes; molybdenum-succinimide complexes; molybdenum salts of organic acids; molybdenum salts of alcohols; and the like. Examples of the molybdenum compound include molybdenum oxides, molybdic acids, metal salts of molybdic acids, molybdates, molybdenum sulfides, sulfurized molybdic acids, metal salts or amine salts of sulfurized molybdic acids, molybdenum halides, and the like. The sulfur-containing organic compound include alkyl (thio)

xanthate, thiadiazole, and the like. In some embodiments, the organic molybdenum compounds are molybdenum dithiophosphate (MoDTP) and molybdenum dithiocarbamate (MoDTC). Further, in some embodiments, the hexavalent molybdenum compounds are the availability standpoint, molybdenum trioxide or hydrogenated products thereof, molybdic acid, alkali metal salts of molybdic acid and ammonium molybdate. Moreover, as the friction modifier of the present disclosure, the trinuclear molybdenum compound described in U.S. Pat. No. 5,906,968 can also be used. In some embodiments, the amount of the friction modifier(s) may be selected as appropriate in accordance with a conventionally known method, and it is not more than 5% by weight, not more than 3% by weight.

Examples of the antioxidants include phenolic ashless antioxidants, amine-based ashless antioxidants, sulfur-based ashless antioxidants, and metal-based antioxidants such as copper-based and molybdenum-based antioxidants. Examples of the phenolic ashless antioxidants include 4,4'-methyienebis(2,6-di-tert-butylphenol), 4,4'-bis(2,6-di-tert-butylphenol), and isooctyl-3-(3,5-di-t-butyl-4-hydroxyphenyl)propionate, and examples of the amine-based ashless antioxidants include phenyl-α-naphthylamine, alkylphenyl-α-naphthylamine, and dialkyldiphenylamine. The antioxidant(s) may be selected as appropriate in accordance with a conventionally known method, and in some embodiments the amount thereof is not more than 5% by weight, not more than 3% by weight.

Examples of the ashless dispersants include nitrogen-containing compounds that have, in a molecule thereof, at least one linear or branched alkyl group or alkenyl group having 40 to 500 carbon atoms, 60 to 350 carbon atoms, and derivatives thereof; Mannich dispersants; mono- or bis-succinimides; benzylamines that have, in a molecule thereof, at least one alkyl group or alkenyl group having 40 to 500 carbon atoms; polyamines that have, in a molecule thereof, at least one alkyl group or alkenyl group having 40 to 400 carbon atoms; and modification products of these compounds, which are obtained by modification with a boron compound, carboxylic acid, phosphoric acid or the like. In some embodiments, the amount of the ashless dispersant(s) to be incorporated may be selected as appropriate in accordance with a conventionally known method, and it is not more than 20% by weight, not more than 10% by weight.

Examples of the viscosity index improvers include those containing a polymethacrylate, a dispersion-type polymethacrylate, an olefin copolymer (e.g., a polyisobutylene or an ethylene-propylene copolymer), a dispersion-type olefin copolymer, a polyalkylstyrene, a styrene-butadiene hydrogenated copolymer, a styrene-maleic anhydride ester copolymer, a diblock copolymer having a vinyl aromatic moiety and a hydrogenated polydiene moiety, a star copolymer, a hydrogenated isoprene linear polymer, a star polymer or the like. A viscosity index improver is usually composed of the above polymer(s) and a diluent oil. In some embodiments, the amount of the viscosity index improver(s) to be incorporated is not more than 10% by weight, not more than 5% by weight, in terms of the polymer amount based on the total amount of the composition.

As an extreme pressure agent, any extreme pressure agent used in a lubricant composition can be employed. For example, a sulfur-based or sulfur-phosphorus-based extreme pressure agent can be used. Specific examples thereof include phosphorous acid esters, thiophosphorous acid esters, dithiophosphorous acid esters, trithiophosphorous acid esters, phosphoric acid esters, thiophosphoric acid esters, dithiophosphoric acid esters, trithiophosphoric acid esters, amine salts thereof, metal salts thereof, derivatives thereof, dithiocarbamates, zinc dithiocarbamate, molybdenum dithiocarbamate, disulfides, polysulfides, olefin sulfides, and sulfurized oils and fats. These extreme pressure agents are usually incorporated into the lubricant composition in an amount of 0.1 to 5% by weight.

Examples of the corrosion inhibitors include benzotriazole-based, tolyltriazole-based, thiadiazole-based and imidazole-based compounds. Examples of the rust inhibitors include petroleum sulfonate, alkylbenzene sulfonates, dinonylnaphthalene sulfonate, alkenyl succinic acid esters, and polyhydric alcohol esters. Usually, these rust inhibitors and corrosion inhibitors are each incorporated into the lubricant composition in an amount of 0.01 to 5% by weight.

As a pour point depressant, for example, a polymethacrylate-based polymer compatible with the lubricant base oil to be used can be employed. Such a pour point depressant is usually incorporated into the lubricant composition in an amount of 0.01 to 3% by weight.

Examples of the demulsifiers include polyalkylene glycol-based nonionic surfactants, such as polyoxyethylene alkyl ethers, polyoxyethylene alkylphenyl ethers and polyoxyethylene alkylnaphthyl ethers. These demulsitiers are usually incorporated into the lubricant composition in an amount of 0.01 to 5% by weight.

Examples of the metal deactivators include imidazoline, pyrimidine derivatives, alkylthiodiazoles, mercaptobenzothiazole, benzotriazole and derivatives thereof, 1,3,4-thiadiazole polysulfide, 1,3,4-thiadiazolyl-2,5-bis-dialkyldithiocarbamate, 2-(alkyldithio)benzimidazole, and β-(o-carboxybenzylthio)propionitrile. These metal deactivators are usually incorporated into the lubricant composition in an amount of 0.01 to 3% by weight.

Examples of the antifoaming agents include silicone oils having a kinematic viscosity at 25° C. of 1,000 to 100,000 $mm^2/s$, alkenyl succinic acid derivatives, esters of an aliphatic polyhydroxy alcohol and a long-chain fatty acid, methyl salicylate, and o-hydroxybenzyl alcohols. These antifoaming agents are usually incorporated into the lubricant composition in an amount of 0.001 to 1% by weight.

EXAMPLES

The present disclosure will now be described in more detail by way of Examples and Comparative Examples thereof; however, the present disclosure is not limited thereto by any refers to.

The below-described amount of evaporated fraction was measured by distillation gas chromatography (GCD). The GCD measurement was performed in accordance with JIS K2254 "Petroleum. Products—Determination of Distillation Characteristics", except that an external standard method was employed in place of the total area method.

Reference Examples 1 and 2, and Comparative Example 1

The below-described ester oils were each added to a lubricant having a high post-evaporation viscosity (commercial product; hereinafter, referred to as "Bad Oil") such that the amount of each ester oil in the resulting composition would be 15% by weight, and the resultant was mixed to prepare a lubricant composition.

The ester oils used in Reference Examples 1 and 2 and Comparative Example 1 are as follows. FIG. 1 provides the GCD curves of these ester oils.

(1) Ester oil of Reference Example 1: an ester oil having a boiling point of 500° C. to 550° C.; ester of trimethylolpropane and capric acid (C10)

(2) Ester oil of Reference Example 2: an ester oil having a boiling point of higher than 550° C. and not higher than 650° C.; ester of trimethylolpropane and stearic acid (C18)

(3) Ester oil of Comparative Example 1: an ester oil having a boiling point of not lower than 400° C. and lower than 500° C.; ester of trimethylolpropane, caprylic acid (C8) and capric acid (C10)

A test for measuring the evaporation loss of each lubricant composition at 250° C., which was believed to correlate with the amount of compressor deposits to be formed (hereinafter, this test is referred to as "deposit simulation test") was carried out. The deposit simulation test was carried out in accordance with the test method prescribed in ASTM D5800, except that the amount of the sample was 50 g and the measurement time was 7 hours.

Figure 2:
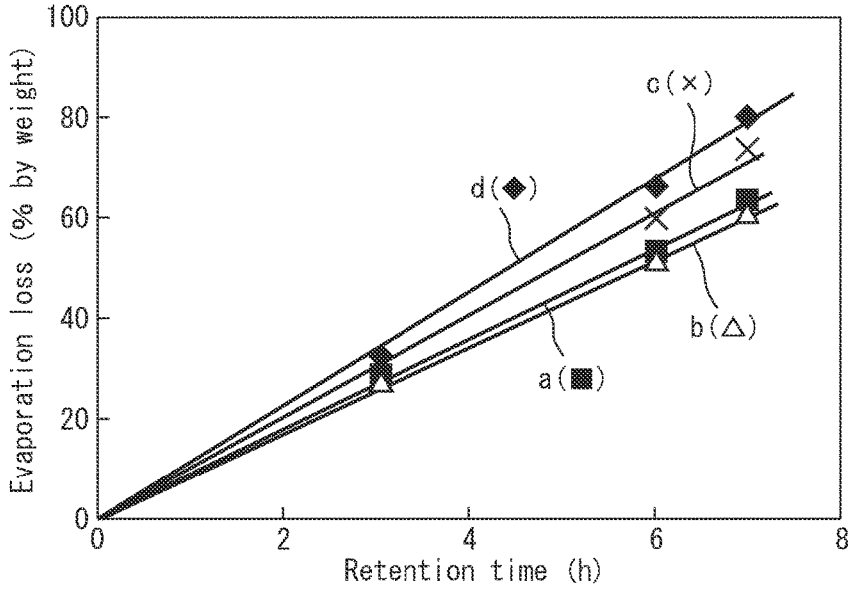
FIG. 2 provides graphs representing the change in evaporation loss over time during a deposit simulation test for Bad Oil and the lubricant compositions of Reference Examples 1 and 2 and Comparative Example 1.

FIG. 2 provides graphs representing the change in evaporation loss (% by weight) over time for each lubricant composition and Bad Oil. In FIG. 2, the graphs represented by a, b, c and d are as follows.

The graph represented by a (symbol: ]](square)) indicates the change in evaporation loss over time for the lubricant composition of Reference Example 1.

The graph represented by b (symbol: Δ(triangle)) indicates the change in evaporation loss over time for the lubricant composition of Reference Example 2.

The graph represented by c (symbol: ×) indicates the change in evaporation loss over time for the lubricant composition of Comparative Example 1.

The graph represented by d (symbol: ♦(diamond)) indicates the change in evaporation loss over time for Bad Oil.

Figure 3:
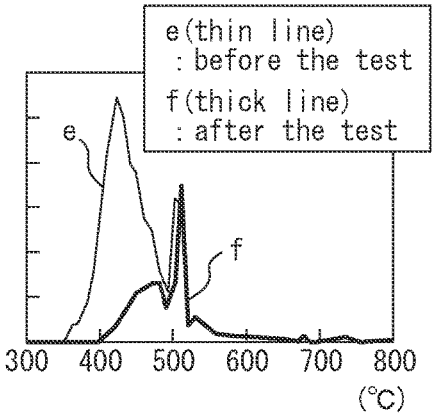
FIG. 3 provides GCD curves obtained before and after a deposit simulation test for the lubricant compositions of Reference Examples 1 and 2.
Figure 3:
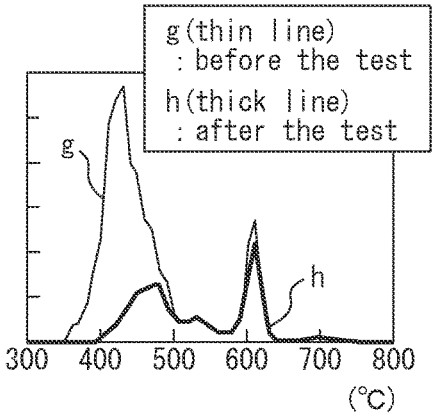

Further, FIG. 3 provides GCD curves obtained before and after the deposit simulation test for the lubricant compositions of Reference Examples 1 and 2. In FIG. 3, the graphs represented by e and g are GCD curves of the respective lubricant compositions before the deposit simulation test, and the graphs represented by f and h are GCD curves of the respective lubricant compositions after the deposit simulation test.

Figure 4:
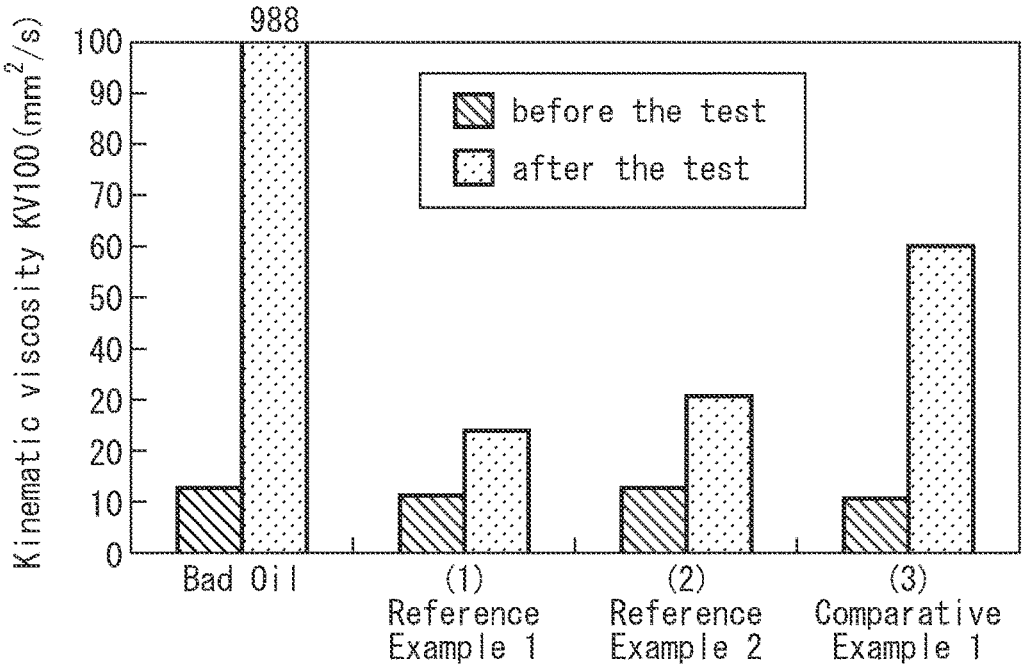
FIG. 4 provides graphs representing the change in the kinematic viscosity before and after a deposit simulation test for Bad Oil and the lubricant compositions of Reference Examples 1 and 2 and Comparative Example 1.

For the lubricant compositions and Bad Oil, the kinematic viscosity was measured before and after the deposit simulation test. The kinematic viscosity was measured at 100° C. in accordance with ASTM D445. FIG. 4 provides graphs of the kinematic viscosity (KV100 ($mm^2/s$)) measured before and after the deposit simulation test.

As indicated in the results of the deposit simulation test (FIG. 2), the ester oils of Reference Examples 1 and 2 exhibited a large effect of reducing the evaporation amount of each lubricant composition. On the other hand, the ester oil of Comparative Example 1 had a small effect of reducing the evaporation amount of the lubricant composition. Further, as depicted in the GCD curves that were obtained before and after the deposit simulation test (FIG. 3), the respective ester components remained in the lubricant compositions of Reference Examples 1 and 2 after the test. Moreover, as indicated in the results of measuring the kinematic viscosity before and after the deposit simulation test (FIG. 4), the ester oils of Reference Examples 1 and 2 had a larger effect of inhibiting an increase in the viscosity of the respective lubricant compositions as compared to the ester oil of Comparative Example 1.

As indicated in the above results of Reference Examples 1 and 2, the fraction having a boiling point of 500° C. to 550° C. and the fraction having a boiling point of higher than 550° C. are capable of reducing the evaporation amount of light fraction contained in a lubricant composition and greatly suppressing an increase in the viscosity of the lubricant composition. Suppression of an increase in the viscosity of the lubricant composition means that the formation of compressor deposits is inhibited.

[Preparation of Lubricant Compositions]

In the below-described Examples and Comparative Examples, lubricant base oils having the properties shown in Table 1 were used.

The lubricant base oils shown in Table 1 below are as follows. The Groups shown in Table 1 correspond to the base oil categories defined by API as shown in Table above.

Refined base oils 1, 2, 3, 4 and 5 are hydrorefined base oils.

FT base oils 1, 2 and 3 are Fischer-Tropsch-derived base oils.

PAO base oils 1, 2 and 3 are poly-α-olefins.

Ester base oil 1 is trimethylolpropane-capric acid ester.

Ester base oil 2 is trimethylolpropane-capric acid-caprylic acid ester.

The test methods of the properties shown in Table 1 were as follows.

(1) The CCS viscosity at −35° C. was measured in accordance with ASTM D5293.

(2) The NOACK evaporation amount was measured in accordance with ASTM D5800 at 250° C. for 1 hour.

(3) The GCD measurement was performed as described above.

(4) The kinematic viscosity and the viscosity index were measured in accordance with ASTM D445.

TABLE 1

| | Amount of evaporated heavy fraction determined by GCD measurement (% by weight) | | CCS viscosity | | NOACK evaporation amount | | |
|---|---|---|---|---|---|---|---|
| | 500 to 550° C. | 550 to 600° C. | (Pa · s, at −35° C.) | Viscosity index | (% by weight, at 250° C.) | KV40 ($mm^2/s$) | KV100 ($mm^2/s$) |
| Refined base oil 1 (3 cSt, Group II base stock) | 0 | 0 | 1.1 | 106 | 42 | 12.4 | 3.1 |
| Refined base oil 2 (4 cSt, Group III base stock) | 0 | 0 | 2.5 | 127 | 15 | 19.0 | 4.2 |
| Refined base oil 3 (6 cSt, Group III base stock) | 17.5 | 2.5 | 8.8 | 134 | 7 | 35.4 | 6.4 |

TABLE 1-continued

| | Amount of evaporated heavy fraction determined by GCD measurement (% by weight) | | CCS viscosity | | NOACK evaporation amount | | |
|---|---|---|---|---|---|---|---|
| | 500 to 550° C. | 550 to 600° C. | (Pa · s, at −35° C.) | Viscosity index | (% by weight, at 250° C.) | KV40 ($mm^2/s$) | KV100 ($mm^2/s$) |
| Refined base oil 4 (4 cSt, Group III base stock) | 1 | 0 | 1.8 | 137 | 13.3 | 17.8 | 4.1 |
| Refined base oil 5 (6 cSt, Group III base stock) | 24 | 4 | 6.6 | 143 | 7.4 | 33.0 | 6.3 |
| FT base oil 1 (3 cSt, Fischer-Tropsch derived base oil) | 1 | 1 | 0.5 | 113 | 42.8 | 9.8 | 2.7 |
| FT base oil 2 (4 cSt, Fischer-Tropsch derived base oil) | 0 | 0 | 1.7 | 128 | 12.5 | 18.1 | 4.1 |
| FT base oil 3 (8 cSt, Fischer-Tropsch derived base oil) | 53.5 | 5.5 | 9.5 | 142 | 2.1 | 44.2 | 7.7 |
| PAO base oil 1 (4 cSt, Group IV) | 4 | 1 | 1.4 | 125 | 12.7 | 18.4 | 4.1 |
| PAO base oil 2 (6 cSt, Group IV) | 34 | 4 | 3.3 | 142 | 5 | 30.0 | 5.9 |
| PAO base oil 3 (10 cSt, Group IV) | 32 | 36 | 17.9 | 136 | 2.2 | 59.3 | 10.4 |
| Ester base oil 1 | 94 | 0 | NA | 149 | 1.9 | 24.7 | 5.2 |
| Ester base oil 2 | 6 | 0 | 2.1 | 133 | NA | 19.3 | 4.3 |

The refined base oils 1, 2 and 4, the FT base oils 1 and 2, the PAO base oil 1 and the ester base oil 2, which are shown in Table 1 above, are lubricant base oils containing a large amount of light fraction.

The above-described lubricant base oils were each mixed with the additives shown below in accordance with the respective formulations and amounts (% by weight) shown in Tables 2, 3 and 4, whereby lubricant compositions were prepared.

Additive: a viscosity index improver having a polymer content ((polymethacrylate (PMA), Mw=150,000 to 500,000) of 30% by weight was incorporated in the respective amounts shown in Tables 2, 3 and 4.

Other additive package: a package containing a metal detergent, an ashless dispersant, an antiwear agent and an antioxidant

TABLE 2

| | (% by weight) | Example 1 | 2 | 3 | 4 | 5 | 6 | 7 | 8 |
|---|---|---|---|---|---|---|---|---|---|
| Base oil | Refined base oil 1 | | | | 15.6 | | | | |
| | Refined base oil 2 | 20.0 | 30.3 | 40.5 | | | | | |
| | Refined base oil 3 | 6.1 | 8.6 | 9.5 | | | | | |
| | Refined base oil 4 | | | | | 20.0 | 28.6 | 36.2 | |
| | Refined base oil 5 | | | | 27.8 | 18.3 | 23.4 | 31.0 | |
| | FT base oil 1 | | | | | | | | 17.2 |
| | FT base oil 2 | | | | | | | | 8.6 |
| | FT base oil 3 | | | | | | | | 42.9 |
| | PAO base oil 1 | | | | | | | | 17.2 |
| | PAO base oil 2 | 60.8 | 47.5 | 36.2 | 43.4 | 48.7 | 34.6 | 19.0 | |
| | Ester base oil | | | | | | | | |

TABLE 2-continued

| (% by weight) | Example 1 | 2 | 3 | 4 | 5 | 6 | 7 | 8 |
|---|---|---|---|---|---|---|---|---|
| Viscosity index improver | 0.7 | 1.2 | 1.4 | 0.8 | 0.6 | 1.0 | 1.4 | 1.7 |
| Additive package | 12.4 | 12.4 | 12.4 | 12.4 | 12.4 | 12.4 | 12.4 | 12.4 |

TABLE 3

| | (% by weight) | Example 9 | 10 | 11 | 12 | 13 | 14 | 15 |
|---|---|---|---|---|---|---|---|---|
| Base oil | Refined base oil 1 | | | | | | | |
| | Refined base oil 2 | | | | | 18.6 | 43.3 | |
| | Refined base oil 3 | | | | | | | 9.5 |
| | Refined base oil 4 | | | | | | | |
| | Refined base oil 5 | | | | | | | |
| | FT base oil 1 | 18.1 | 16.3 | | | | | |
| | FT base oil 2 | 23.3 | 30.1 | 34.6 | 49.3 | | | |
| | FT base oil 3 | 44.4 | 39.6 | 21.6 | 27.9 | | | |
| | PAO base oil 1 | | | | | 3.4 | | |
| | PAO base oil 2 | | | 30.3 | 8.6 | 62.6 | 40.0 | 36.2 |
| | Ester base oil 2 | | | | | | | |
| Viscosity index improver | | 1.8 | 1.6 | 1.1 | 1.8 | 3.0 | 4.3 | 1.4 |
| Additive package | | 12.4 | 12.4 | 12.4 | 12.4 | 12.4 | 12.4 | 12.4 |

TABLE 4

| | | Comparative Example | | | | | Reference Example | |
|---|---|---|---|---|---|---|---|---|
| | (% by weight) | 2 | 3 | 4 | 5 | 6 | 3 | 4 |
| Base oil | Refined base oil 1 | | | | | | | |
| | Refined base oil 2 | | 54.2 | 68.8 | 70.2 | | | |
| | Refined base oil 3 | | 6.0 | 4.3 | | | | |
| | Refined base oil 4 | 51.6 | | | | | | |
| | Refined base oil 5 | 25.8 | | | | | | |
| | FT base oil 1 | | | | | 16.0 | 13 | 15.0 |
| | FT base oil 2 | | | | | | | 27.0 |
| | FT base oil 3 | | | | | 14.0 | 44 | |
| | PAO base oil 1 | | | | | 48.6 | | |
| | PAO base oil 2 | 8.6 | 25.8 | | 14.4 | | | |
| | PAO base oil 3 | | | | | | | |
| | Ester base oil 1 | | | 12.9 | | 5.0 | 30.0 | |
| Viscosity index improver | | 1.6 | 1.6 | 1.6 | 3.0 | 4.0 | 0.6 | 0.6 |
| Additive package | | 12.4 | 12.4 | 12.4 | 12.4 | 12.4 | 12.4 | 12.4 |

For each of the lubricant compositions shown in Tables 2 and 3 above, the amount of evaporated fraction (% by weight), the CCS viscosity at −35° C., the amount of paraffin (% by weight), the amount of monocyclic naphthene (% by weight) and the HTHS viscosity at 150° C. were measured. The results thereof are shown in Tables 5 to 7 below.

The method of testing the amount of evaporated fraction, the CCS viscosity at −35° C. and the NOACK evaporation amount were as described above. Other test methods were as follows.

(1) The HTHS viscosity at 150° C. was measured in accordance with ASTM D4683.

(2) The paraffin content and the monocyclic naphthene content were measured by field desorption ionization-mass spectrometry (PD-MS method). The measurement may be performed in accordance with the method described in "Type Analysis of Lubricant Base Oil by Mass Spectrometer," Nisseki Technical Review, vol. 33, no. 4, October 1991, pages 135-142.

(3) The kinematic viscosity (KV100 ($mm^2/s$)) was measured before and after the deposit simulation test in accordance with ASTM D445. The deposit simulation test was carried out in accordance with the method of ASTM D5800, except that the amount of the sample was 50 g and the measurement time was 7 hours.

TABLE 5

| | Example | | | | | | | |
|---|---|---|---|---|---|---|---|---|
| | 1 | 2 | 3 | 4 | 5 | 6 | 7 | 8 |
| Amount of fraction having a boiling point of 500 to 550° C. (% by weight) | 21 | 17 | 14 | 23 | 19 | 16 | 16 | 25 |
| Amount of fraction having a boiling point of higher than 550° C. (% by weight) | 8 | 7 | 6 | 7 | 10 | 10 | 8 | 5 |
| CCS viscosity at −35° C. (Pa · s) | 5.9 | 6.0 | 6.1 | 6.2 | 5.9 | 5.9 | 6.1 | 5.7 |
| Amount of paraffin (% by weight) | 66 | 56 | 47 | 58 | 64 | 55 | 46 | 59 |
| Amount of monocyclic naphthene (% by weight) | 8 | 12 | 15 | 16 | 16 | 22 | 28 | 24 |
| HTHS viscosity at 150° C. (mPa · s) | 2.6 | 2.6 | 2.6 | 2.6 | 2.6 | 2.6 | 2.6 | 2.7 |
| NOACK evaporation amount [% by weight] at 250° C. | 7 | 8 | 9 | 11 | 7 | 8 | 9 | 12 |
| Kinematic viscosity of lubricant composition before deposite simulation test, KV100 ($mm^2/s$) | 7.9 | 7.9 | 7.9 | 7.7 | 7.8 | 7.8 | 7.9 | 8.1 |
| Kinematic viscosity of lubricant composition after deposite simulation test, KV100 ($mm^2/s$) | 10.5 | 11.5 | 14.2 | 12.2 | 10.5 | 12.7 | 11.8 | 17.1 |

TABLE 6

| | Example | | | | | | |
|---|---|---|---|---|---|---|---|
| | 9 | 10 | 11 | 12 | 13 | 14 | 15 |
| Amount of fraction having a boiling point of 500 to 550° C. (% by weight) | 24 | 22 | 20 | 17 | 22 | 14 | 17 |
| Amount of fraction having a boiling point of higher than 550° C. (% by weight) | 6 | 7 | 7 | 7 | 8 | 6 | 8 |
| CCS viscosity at −35° C. (Pa · s) | 6.2 | 5.9 | 6.0 | 6.1 | 5.9 | 6.2 | 5.6 |
| Amount of paraffin (% by weight) | 54 | 54 | 67 | 59 | 70 | 49 | 79 |

TABLE 6-continued

| | Example | | | | | | |
|---|---|---|---|---|---|---|---|
| | 9 | 10 | 11 | 12 | 13 | 14 | 15 |
| Amount of monocyclic naphthene (% by weight) | 27 | 27 | 16 | 22 | 5 | 13 | 3 |
| HTHS viscosity at 150° C. (mPa · s) | 2.7 | 2.6 | 2.6 | 2.7 | 2.9 | 3.0 | 2.8 |
| NOACK evaporation amount [% by weight] at 250° C. | 13 | 12 | 7 | 8 | 7 | 9 | 5 |
| Kinematic viscosity of lubricant composition before deposite simulation test, KV100 ($mm^2/s$) | 8.1 | 7.8 | 8.0 | 8.1 | 9.3 | 9.7 | 8.2 |
| Kinematic viscosity of lubricant composition after deposite simulation test, KV100 ($mm^2/s$) | 13.7 | 15.3 | 11.9 | 15.3 | 12.3 | 18.4 | 9.0 |

TABLE 7

| | Comparative Example | | | | | Reference Example | |
|---|---|---|---|---|---|---|---|
| | 2 | 3 | 4 | 5 | 6 | 3 | 4 |
| Amount of fraction having a boiling point of 500 to 550° C. (% by weight) | 11 | 11 | 12 | 6 | 14 | 52 | 15 |
| Amount of fraction having a boiling point of higher than 550° C. (% by weight) | 5 | 6 | 5 | 4 | 4 | 5 | 26 |
| CCS viscosity at −35° C. (Pa · s) | 6.1 | 5.9 | 5.7 | 6.0 | 3.8 | 109.2 | 7.7 |
| Amount of paraffin (% by weight) | 40 | 39 | 29 | 30 | 72 | 64 | 73 |
| Amount of monocyclic naphthene (% by weight) | 32 | 18 | 21 | 20 | 10 | 21 | 10 |
| HTHS viscosity at 150° C. (mPa · s) | 2.6 | 2.5 | 2.4 | 2.6 | 2.7 | 2.8 | 2.8 |
| NOACK evaporation amount [% by weight] at 250° C. | 10 | 10 | 11 | 12 | 15 | 7 | 11 |
| Kinematic viscosity of lubricant composition before deposite simulation test, KV100 ($mm^2/s$) | 7.7 | 7.6 | 7.2 | 8.1 | 8.4 | 8.1 | 8.4 |
| Kinematic viscosity of lubricant composition after deposite simulation test, KV100 ($mm^2/s$) | 17.5 | 22.4 | not measureable*1 | not measureable*1 | not measureable*1 | 9.8 | 16.8 |

*1Measurement could not be made due to excessively high viscosity

As shown in Table 7, the lubricant compositions of Comparative Examples 2, 3, 4, 5 and 6 had a low viscosity at a low temperature; however, these compositions exhibited a high rate of increase in the kinematic viscosity (KV100) before and after the deposit simulation test. In Comparative Examples 4, 5 and 6, the kinematic viscosity could not be measured after the deposit simulation test due to an excessively large increase in the viscosity. As indicated in Comparative Example 6, even when a fraction having a boiling point of 500° C. to 550° C. is incorporated in a large amount, if the amount of a fraction having a boiling point of higher than 550° C. is too small, the viscosity is largely increased during the deposit simulation test, so that the formation of compressor deposits cannot be sufficiently inhibited. Further, as indicated in Reference Examples 3 and 4, when the amount of a fraction having a boiling point of 500° C. to 550° C. is greater than the above upper limit value or the amount of a fraction having a boiling point of higher than 550° C. is greater than the above upper limit value, although the formation of compressor deposits can be inhibited, good low-temperature viscosity characteristics cannot be attained.

In contrast, as shown in Tables 5 and 6, in the lubricant compositions according to the present disclosure, the NOACK evaporation amount was small and an increase in the kinematic viscosity (KV100) before and after the deposit simulation test was suppressed. Therefore, these lubricant compositions have an effect of inhibiting the formation of compressor deposits. Furthermore, in addition to this effect, the lubricant compositions according to the present disclosure also have a low viscosity at low temperatures.

INDUSTRIAL APPLICABILITY

The present disclosure can provide a lubricant composition in which the effect of inhibiting the formation of compressor deposits is further improved. In addition, the present disclosure can provide a lubricant composition which has good low-temperature characteristics in addition to the above effect. Therefore, in some embodiments, the lubricant composition of the present disclosure can be used as a lubricant composition for internal-combustion engines, as a lubricant composition for diesel engines.

The invention claimed is:

1. A lubricant composition comprising:

not less than 14% and not more than 50% by weight of a fraction having a boiling point of 500° C. to 550° C.; and not less than 5% and not more than 20% by weight of a fraction having a boiling point of higher than 550° C.

2. The lubricant composition according to claim 1, wherein the lubricant composition has a NOACK evaporation amount that is not more than 20% by weight.

3. The lubricant composition according to claim 1 wherein the lubricant composition has a CCS viscosity at −35° C. that is not more than 6.2 Pa·s.

4. The lubricant composition according to claim 1 further comprising not less than 45% by weight of paraffin.

5. The lubricant composition according to claim 4 further comprising not less than 1% by weight of monocyclic naphthene.

6. The lubricant composition according claim 1, wherein the lubricant composition has a high-temperature high-shear viscosity (HTHS viscosity) of 2.0 to 3.5 mPa·s at 150° C.

7. The lubricant composition according claim 1 further comprising an ester base oil.

8. The lubricant composition according claim 1 further comprising a poly-α-olefin (PAO) base oil.

9. The lubricant composition claim 1 further comprising a Fischer-Tropsch-derived base oil.

10. The lubricant composition according claim 1, wherein the lubricant composition is applied in an internal-combustion engine.

11. The lubricant composition according to claim 10, wherein the internal-combustion engine is a diesel engine.

12. A method of inhibiting formation of compressor deposits comprising:

applying a lubricant composition in a diesel engine, wherein the lubricant composition comprises:

not less than 14% and not more than 50% by weight of a fraction having a boiling point of 500° C. to 550° C.; and not less than 5% and not more than 20% by weight of a fraction having a boiling point of higher than 550° C.

13. The method of inhibiting formation of compressor deposits according to claim 12, wherein the lubricant composition has a NOACK evaporation amount that is not more than 20% by weight.

14. The method of inhibiting formation of compressor deposits according to claim 12, wherein the lubricant composition has a CCS viscosity at −35° C. that is not more than 6.2 Pa·s.

15. The method of inhibiting formation of compressor deposits according to claim 1, wherein the lubricant composition further comprises not less than 45% by weight of paraffin.

16. The method of inhibiting formation of compressor deposits according to claim 15, wherein the lubricant composition further comprises not less than 1% by weight of monocyclic naphthene.

17. The method of inhibiting formation of compressor deposits according to claim 12, wherein the lubricant composition has a high-temperature high-shear viscosity (HTHS viscosity) of 2.0 to 3.5 mPa·s at 150° C.

18. The method of inhibiting formation of compressor deposits according to claim 12, wherein the lubricant composition further comprises an ester base oil.

19. The method of inhibiting formation of compressor deposits according to claim 12, wherein the lubricant composition further comprises a poly-α-olefin (PAO) base oil.

20. The method of inhibiting formation of compressor deposits according to claim 1, wherein the lubricant composition further comprises a Fischer-Tropsch-derived base oil.

* * * * *